United States Patent [19]

Aretz et al.

[11] Patent Number: 4,576,340

[45] Date of Patent: Mar. 18, 1986

[54] DEVICE FOR DEPOSITING AND KEEPING THE THREAD END IN THE COP TUBE OF A SPINNING COP PASSED ON FROM A COP PREPARATION STATION TO TRANSPORTING MEANS

[75] Inventors: Ulrich Aretz, Korschenbroich; Heinz Bühren, Monchen-Gladbach, both of Fed. Rep. of Germany

[73] Assignee: W. Schlafhorst & Co., Monchen-Gladbach, Fed. Rep. of Germany

[21] Appl. No.: 556,627

[22] Filed: Nov. 30, 1983

[30] Foreign Application Priority Data

Dec. 1, 1982 [DE] Fed. Rep. of Germany ..... 3244378

[51] Int. Cl.[4] ..... B65H 67/06

[52] U.S. Cl. ..... 242/35.5 A; 242/35.6 E

[58] Field of Search ..... 242/35.5 A, 35.5 R, 242/35.6 R, 35.6 E

[56] References Cited

U.S. PATENT DOCUMENTS

| | | | |
|---|---|---|---|
| 3,111,280 | 11/1963 | Reiners et al. | 242/35.5 R |
| 3,295,775 | 1/1967 | Raasch et al. | 242/35.5 R |
| 3,464,640 | 9/1969 | Kupper | 242/35.6 E |
| 3,471,101 | 10/1969 | Moyer et al. | 242/35.6 R |
| 3,480,128 | 11/1969 | Brouwer et al. | 242/35.5 R |
| 3,480,216 | 11/1969 | Iannucci et al. | 242/35.6 R |
| 3,544,018 | 12/1970 | Stoppard et al. | 242/35.6 R |
| 3,727,852 | 4/1973 | Nelson et al. | 242/35.6 R |
| 3,850,378 | 11/1974 | Savio | 242/35.6 E |
| 3,897,022 | 7/1975 | Savio | 242/35.6 E |
| 3,941,323 | 3/1976 | D'Agnolo et al. | 242/35.6 E X |
| 4,009,840 | 3/1977 | Muller | 242/35.6 E |
| 4,010,907 | 3/1977 | Nishiyama et al. | 242/35.6 E X |
| 4,103,836 | 8/1978 | Kupper | 242/35.6 E |

*Primary Examiner*—Stanley N. Gilreath

*Attorney, Agent, or Firm*—Herbert L. Lerner; Laurence A. Greenberg

[57] ABSTRACT

A device for depositing and keeping a thread end in a cop tube of a spinning cop from a cop delivery point of a cop preparation station to a cop transporting device includes a pivotable chute with upper and lower ends disposed between the cop delivery point and the cop transporting device for receiving a spinning cop with a dragged-along thread end, a switchable suction device disposed at the lower end of the chute for supplying the cop tube with suction, and a device for tilting the chute from a vertical position to a horizontal position, the tilting device including a device for limiting acceleration and deceleration of the spinning cop in the chute during tilting.

11 Claims, 9 Drawing Figures

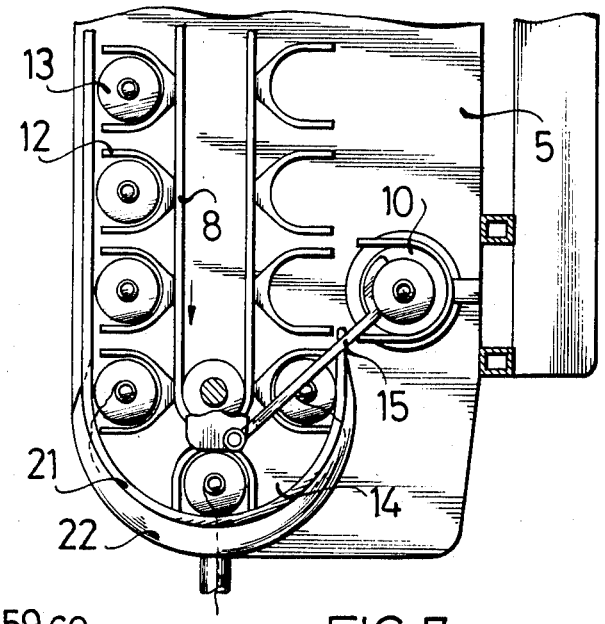
FIG. 5
FIG. 6
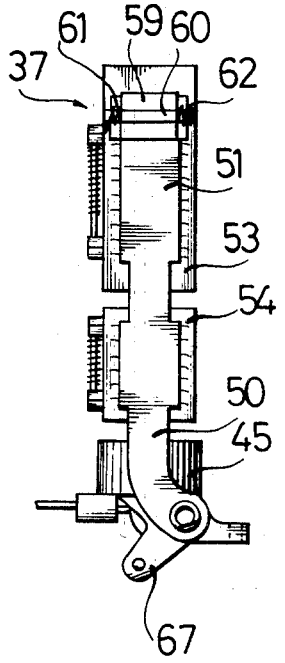
FIG. 7
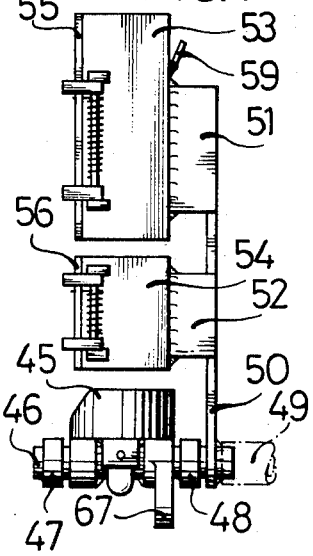
FIG. 8
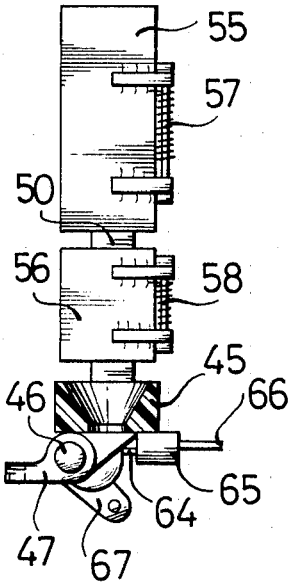
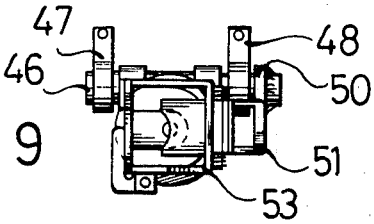
FIG. 9

DEVICE FOR DEPOSITING AND KEEPING THE THREAD END IN THE COP TUBE OF A SPINNING COP PASSED ON FROM A COP PREPARATION STATION TO TRANSPORTING MEANS

The invention relates to a device for keeping a thread end of a spinning cop in the cop tube, from a cop preparation station to cop transportation means.

As is well known, spinning cops are prepared for rewinding in a cop preparation station. The rewinding preferably takes place in automatically operating bobbin winding machines which produce a cross-wound bobbin from several spinning cops. For every cross-wound bobbin, the bobbin winding machine must change the spinning cops serving as supply coils several times in succession. In order for this to be accomplished quickly and automatically, it is necessary to put the thread end of each spinning cop in readiness at a defined point. It has been found to be advantageous and practical to deposit the thread end in the interior of the cop tube.

In the case of fine and sensitive threads, in an automatically operating cop preparation station, it is difficult to find the thread end on the spinning cop, to insert it into the cop tube and to see to it that it stays there. If, for instance, the thread end is already inserted into the cop tube and especially if the threads are heavily twisted, the thread tries to spring back out of the cop tube after the inserting force ceases. Small cop movements or an air draft may even be sufficient to fling the thread end out of the cop tube again. For this reason, the proportion of cops that cannot be prepared is rather high. The operating personnel can hardly correct this because it is very difficult to insert the end of a thin thread into the cop tube by hand. The time required for this is much too long. The sorted-out spinning cops which were not prepared in the first pass must therefore be returned to the cop preparation station. Thus cops which cannot be prepared continuously pass through the cop preparation station. This can go so far that the cop preparation station is no longer capable of furnishing a sufficient amount of prepared spinning cops to a subsequent automatic bobbin winding machine.

The invention is based on the insight that the thread ends already inserted into the cop tube already become dislodged from the cop tube again on the way from the cop preparation station to the transporting means loading an automatic bobbin winding machine and that this amounts to a large percentage of the cops getting to the winding stations of the bobbin winding machine in an insufficiently prepared state. It is an object of the invention to provide a remedy for this situation and to see to it that the thread end is properly laid into the cop tube and is then also held-in on the way to the transporting means.

According to the invention, this problem is solved by arranging a chute between the cop delivery point of the cop preparation station and the transporting means, which can be swung from the vertical into the horizontal position, which receives the cop with the trailing thread end, and which has a switchable suction device at the lower end which subjects the cop tube to suction air, and a tilting device which is equipped with means for limiting the acceleration and deceleration of the cop.

The thread end is now advantageously sucked into the cop tube at the point where the spinning cop begins to be transported from the cop delivery point to the transporting means. At the same time, provision is made that during this transport to the transporting means, abrupt movements of the spinning cop no longer occur. All this together leads to the situation in which well prepared spinning cops reach the transporting means, for instance, a conveyer belt leading to an automatic bobbin winding machine.

In order to prevent trailing threads from protruding from the cop tube during transport from the delivery point to the transporting means, it is proposed, in a further embodiment of the invention, that the suction device comprises a controlled thread cutter. The thread cutter can be arranged in the suction device itself or at the mouth of the suction device.

In a further embodiment of the invention it is proposed that a cop retainer controlled by the chute is arranged at the cop delivery point of the cop preparation station. The cop retainer is to prevent the cop delivery point from unintentionally delivering a spinning cop if the chute is not in the vertical position. The cop retainer may, for instance, take the form of a swing which, when the chute is swung back into the vertical position, can be taken along and can be swung out laterally, and when the chute is swung into the horizontal position, can be released. The cop delivery point is arranged so that it can be closed. This requires no complicated devices. The chute itself can push the swing to one side and also release it again when it is swung into the horizontal position. When the swing is swung away, a spinning cop standing on the swing at the cop delivery point loses its hold and drops or slides into the chute. The upright position of the chute must still allow at least a sliding motion under the action of gravity.

As long as the spinning cop is still at the cop delivery point of the cop preparation station, a thread suctioning device can act on it with the objective of sucking up the thread end and holding it. If the spinning cop thereupon falls into the chute, this thread end is to be pulled out to a predetermined minimum length and dragged along. Otherwise, it is impossible to suck a sufficiently long thread end into the cop tube. In order to ensure that only those spinning cops are now transported-on by the transporting means which have a sufficiently long thread end, it is proposed, in a further embodiment of the invention, that above the cop retainer, a thread-presence feeler is arranged which can be activated with delay when the retained cop is released and which has a functional connection with a cop shunting switch following the chute. The presence of a thread is therefore ascertained only if the spinning cop has already arrived in the chute. The distance from the thread-presence feeler to the cop in the chute determines the desired minimum length of the thread end. If the thread-presence feeler ascertains sufficient thread length, the cop shunting switch is not activated. If, however, the thread-presence feeler determines that no thread of sufficient length is dragged along, the cop shunting switch opens automatically, so that the respective spinning cop, while it still may be able to be placed on the transporting means, is led off there at the latest and is optionally returned for a new cop preparation.

In a further embodiment of the invention, the thread-presence feeler can at the same time be designed as a cop-presence feeler and can have a time delay device which, after the cop-presence signal has ceased at the end of a set delay time, switches from cop measurement to thread measurement. This has the advantage that only a single measuring device is needed.

In the relationship of the cop preparation station to the transporting means and vice versa, tying problems may arise under some circumstances. This is the case, for instance, if the transporting means already belong to a bobbin winding machine, but the cop preparation station is installed separately or is to be retrofitted. To overcome these difficulties, it is proposed, in a further embodiment of the invention, that a horizontal conveyer is arranged between the chute and the transporting means, which is likewise provided with means for limiting the acceleration and deceleration of the cop. Such a horizontal conveyer has the further advantage of being able to be set to a transport speed which corresponds to the transport speed of subsequent transporting means. In this case, neither acceleration nor deceleration of the cop occurs during the transfer of the cop to the transporting means.

The chute operates intermittently. This therefore suggests that the horizontal conveyer also operate intermittently synchronously with the chute. It is advantageous in this case if the means for limiting the acceleration and deceleration of the cop each consist of a crank drive for the purpose of swinging the chute as well as for moving the horizontal conveyer. The start of the motion is then placed on the dead center point, as is the end of the motion.

The chute can have accessories protecting the spinning cop. Thus, it is advantageous, for instance, if it is bounded on one side by at least one flap permitting emptying to one side. As soon as the chute has assumed the horizontal position, the flap is opened and the spinning cop is taken laterally from the chute. This can be accomplished by discharging elements of a horizontal conveyer. The chute can advantageously have in its interior a device for preventing thread layers from being knocked off. The suction air stream, by means of which the thread end is sucked into the cop tube, must not be too weak. During the thread suction time, the thread can therefore assume such a high velocity that thread layers are set at a slant and later, in the further processing of the spinning cop, form a running-off obstacle. This can be prevented by the proposed device. In the simplest case, such a device consists of a flap which rests against the cop surface slightly and resiliently. The flap may be intrinsically resilient but it may also be loaded by a wound spiral spring, for instance. The device for preventing thread layers from being knocked off also acts as a thread brake on the thread which is drawn-off by suction. The thread loss due to suction is kept within limits for this reason.

An embodiment example of the invention is shown in the drawings. The invention will be described and explained in greater detail, referring to this embodiment example.

FIG. 5 is a fragmentary, top-plan view showing details of the cop preparation station.

FIGS. 6 to 9 show the chute in a rear view, a side view, a front view and a top-plan view, respectively.

Figure 1:
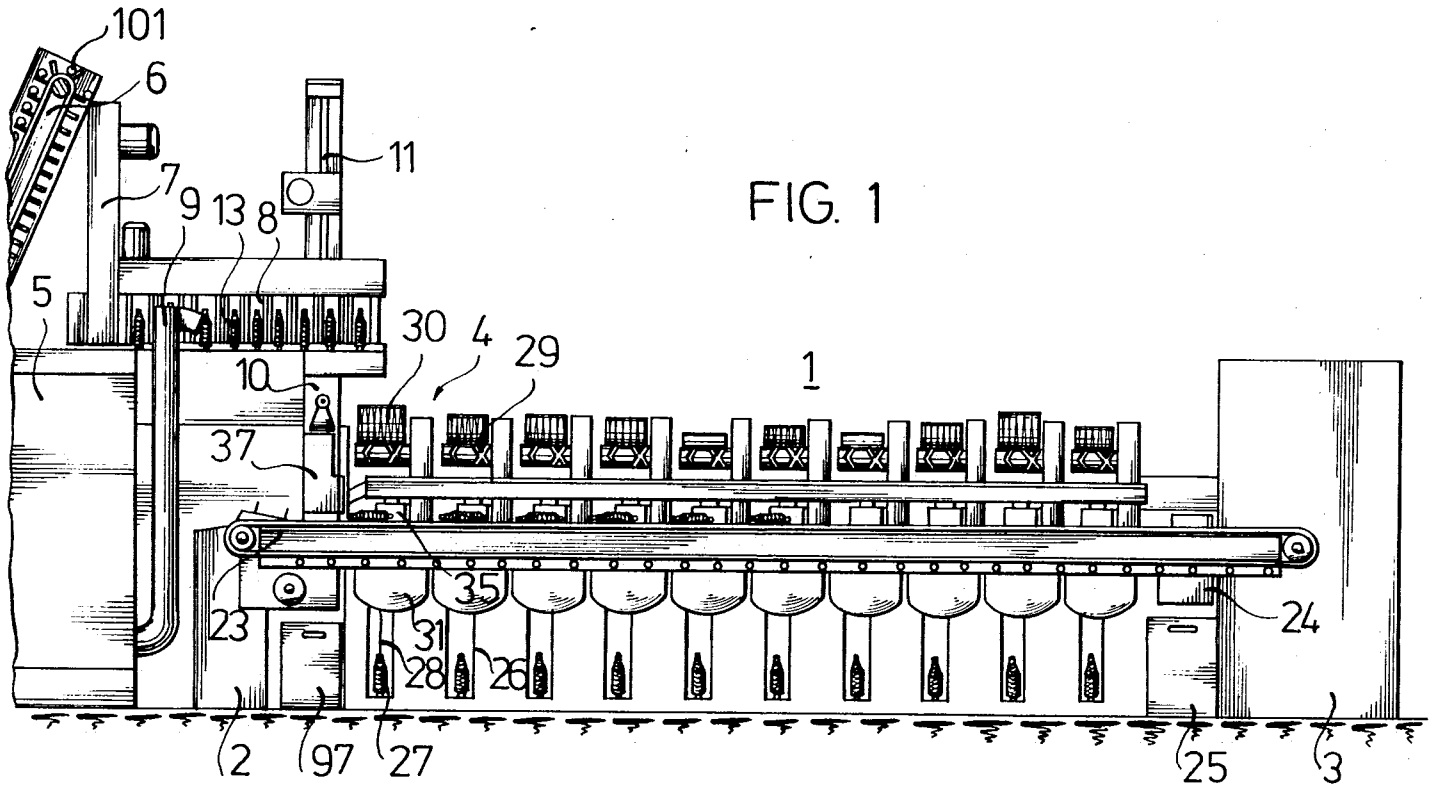
FIG. 1 is a diagrammatic, side-elevational view of a bobbin winding machine with a built-on cop preparation station.

According to FIG. 1, the automatic bobbin winding machine 1 consists, as far are its main parts are concerned, of a front end frame 2, a rear end frame 3 and ten interposed identical winding stations 4. Installed next to the front end frame 2 is a cop preparation station designated as a whole with reference numeral 5. The parts of the cop preparation station which are visible in detail in FIG. 1 are an elevator 6, a cop turner 7, a cop conveyer belt 8, a blower device 9 and a cop delivery point 10, part of which is also an individual feeder 11.

Figure 2:
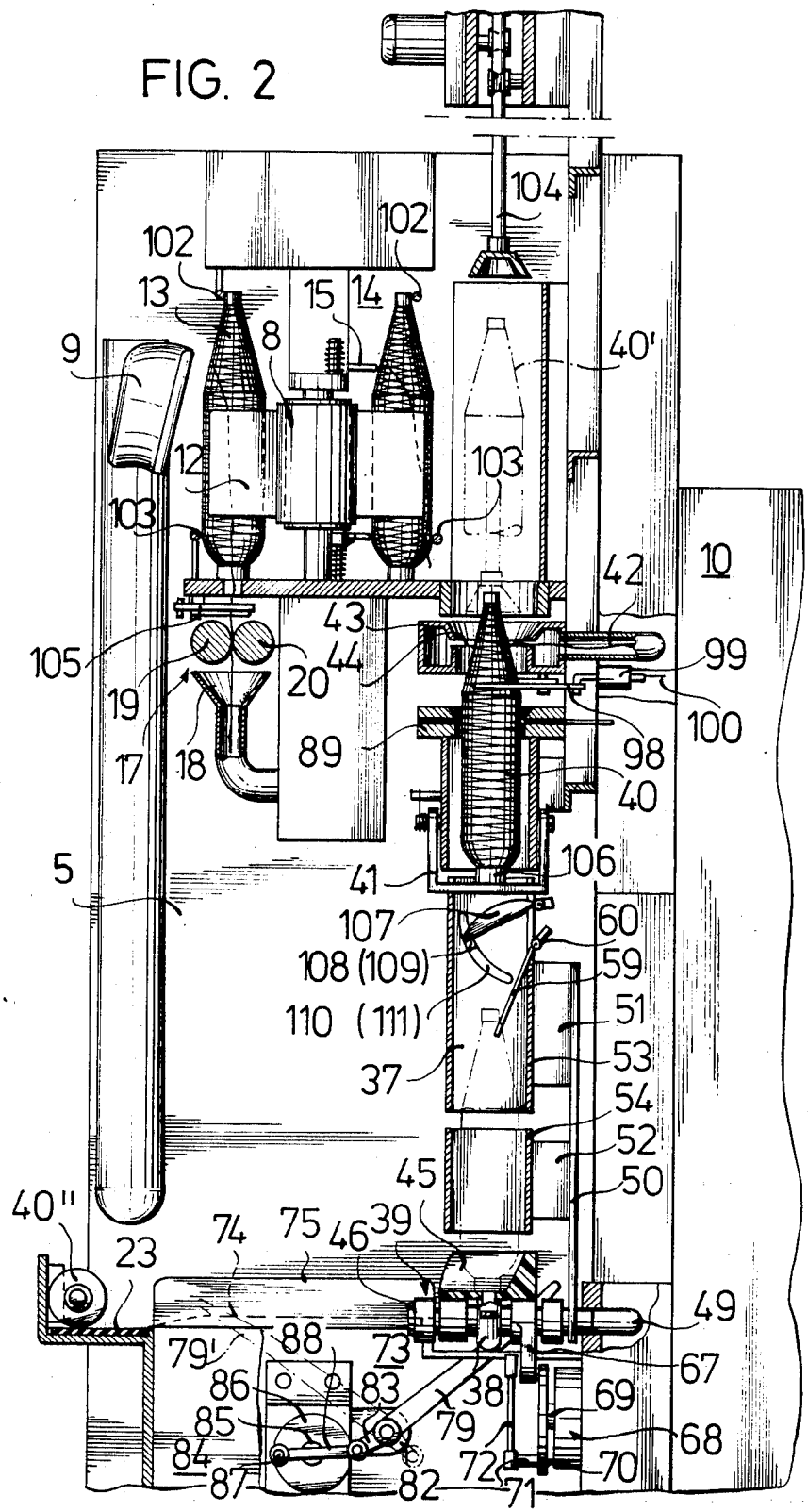
FIG. 2 is a fragmentary, diagrammatic view of the cop preparation station with the chute cut open.

FIGS. 2 and 5 show that the cop conveyer belt 8 feeds spinning cops 13 contained in individual pockets 12 to a reversing point 14, where the transport direction of the cops 13 is reversed and where a controlled feeder 15 passes one spinning cop after another on to the cop delivery point 10. The thread ends are blown away downward along the cop surface by means of the blower device 9, are gripped there by a drawing-off device 17 and are drawn off into a funnel 18 where they are suctioned off. The drawing off device 17 comprises the two driven drawing-off rolls 19 and 20. The thread ends dragged along by the individual spinning cops 13 come into the suction slot 21 of a suction device 22 at the reversing point 14.

The cop preparation station 5 is followed by transporting means in the form of a conveyer belt. The transporting means 23 are guided past the winding stations 4 along the bobbin winding machine 1. At the end of the transporting means 23 there is an overflow 24 which opens into a collecting box 25.

Figure 4:
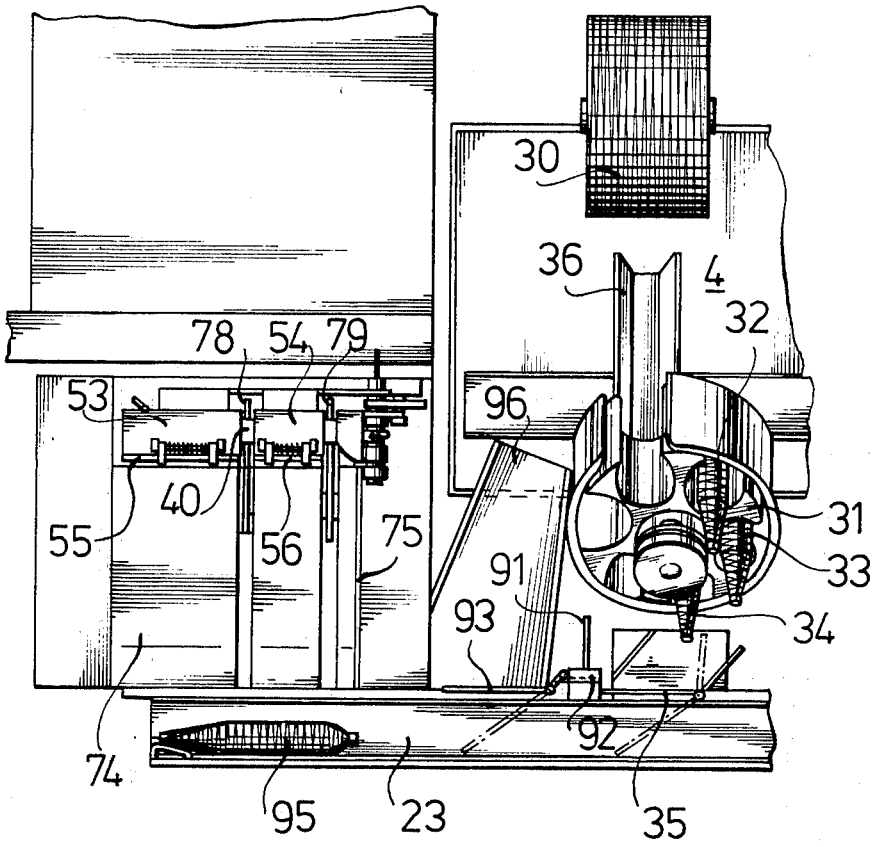
FIG. 4 is a fragmentary, top-plan view onto the chute in the horizontal position and the first winding station of the bobbin winding machine.

According to FIG. 1 and FIG. 4, the winding station 4 has a discharge point 26 which is occupied by an unwinding cop 27. The thread 28 drawn from the running-off cop 27 travels over a driving roll 29 provided with reversing thread grooves, to a wind-up bobbin 30 which is in the form of a cross-wound coil and rolls off on the drive roll 29. A rotatable unwinding cop magazine 31, which is designed as a circular magazine, always keeps two to three further unwinding cops 32 to 34 in reserve. These are already prepared unwinding cops, the thread end of which is inserted into the cop tube. A controlled shunt 35 always permits the detour of an unwinding cop from the transporting means 23 and lets it slide into an empty pocket of the run-off cop magazine 31 if, a running-down cop has already been delivered to the discharge point 26 via a slide 36. All ten winding stations of the automatic bobbin winding machine 1 are designed like the winding station 4.

Disposed between the cop delivery point 10 of the cop preparation station 5 and the transporting means 23, is a chute 37 which has a switchable suction device 38 and a tilting device 39 at the lower end thereof. The chute 37 is capable of sequentially accepting spinning cops, for instance, the spinning cop 40 which is just being held in reserve at the cop delivery point 10 according to FIG. 2 and which is to be used later as the unwinding coil at the automatic bobbin winding machine 1. The chute 37 can be swung from an upright position into the horizontal position. In the present embodiment example, the upright position is equated with the vertical position.

Figure 3:
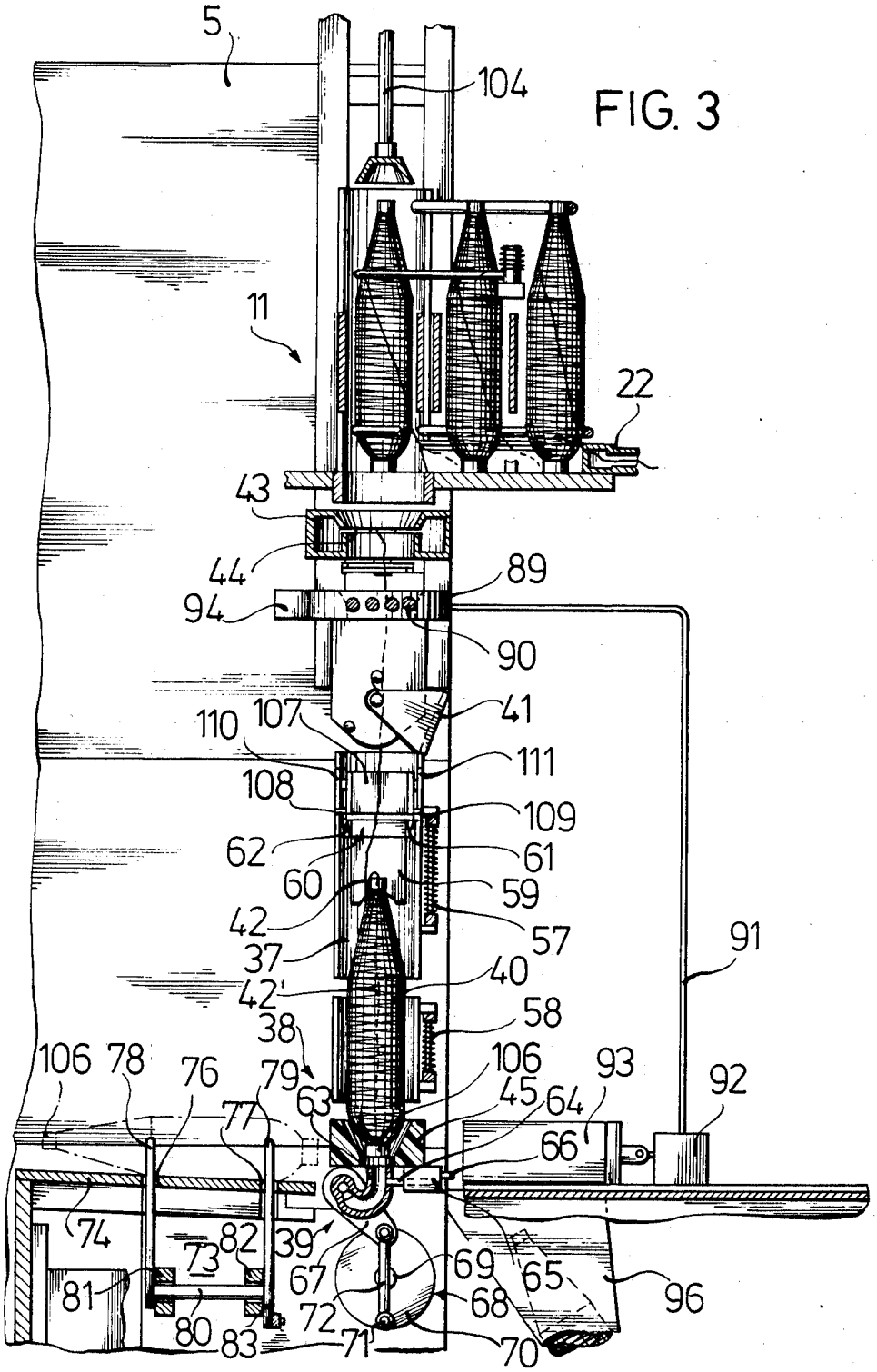
FIG. 3 is a diagrammatic view of the chute and a subsequent horizontal conveyer at the time when the suction begins.

At the cop delivery point 10 of the cop preparation station 5, a cop retainer 41 is arranged which can be controlled by the chute 37. The cop retainer 41 is in the form of a swing which can be taken along into the vertical position when the chute 37 is swung back, and can be swung out laterally, as shown in FIG. 3. FIG. 3 also indicates that in the process, the spinning cop 40 loses its support on the cop retainer 41 and drops into the chute 37. Its thread end 42 is dragged along because it is held in a suction device 43 which has an annular slit nozzle 44.

As is shown particularly in FIGS. 6 to 9, the chute 37 consists of several parts. At its base there is a funnel 45 which is fastened to a hollow shaft 46. The hollow shaft 46 is supported in two stationary pillow blocks 47, 48. One end of the hollow shaft 46 is closed and the other end is connected to a suction line 49. A carrier 50 which has two cross pieces 51, 52, is welded to the hollow shaft 46. The cross piece 51 is arranged above the cross piece 52. The cross piece 51 carries an upper chute body 53 and the lower cross piece 52 carries a lower chute body 54. Toward the front, the upper chute body 53 can be closed off by a flap 55 and the lower chute body by a flap 56, as is shown particularly in FIG. 8. The flap 55 is held in the closed position by a wound spiral spring 57 and the flap 56 is held by a wound spiral spring 58. In its interior, the chute 37 has a device 59 for preventing thread layers from being knocked off. The device 59 consists of a flap which rests lightly and resiliently against the cop surface. To this end, the flap 59 has a pivot shaft 60 which carries two wound spiral springs 61, 62.

The suction device 38 has a curved suction tube 63 which leads from the hollow shaft 46 to the base of the funnel 45. The suction device 38 is switchable inasmuch as the suction tube 63 can be closed off by a controlled thread cutter 64. Simultaneously with the closing of the suction tube 63, a possibly sucked-up thread end is cut off by the thread cutter 64. The control device of the thread cutter 64 is designated with reference numeral 65. This is an electromagnetic control device, the connecting cable 66 of which, is flexible.

The tilting device 39, of which the tiltable hollow shaft 46 is a part, has a lever 67 fastened to the hollow shaft. The lever 67 is connected to a crank drive 68. The crank drive serves not only as the driving means, but also as means for limiting the acceleration and deceleration of the cop 40 during a swinging motion of the chute 37. The crank drive 68 consists of a drive shaft 69, a flywheel 70, a crank pin 71 fastened to the flywheel 70 and a connecting rod 72 which is linked to the lever 67.

Disposed between the chute 37 and the transporting means 23, is a horizontal conveyer 73. The horizontal conveyer 73 has an approximately horizontal sliding surface 74 which is bounded by a side wall 75. Two slots 76, 77 are worked into the sliding surface 74. The slots 76 and 77 serve as guides for two transport levers 78 and 79. Both transport levers 78, 79 are fastened on a shaft 80 which is supported below the sliding surface 74 in pillow blocks 81, 82. A lower extension 83 of the transport lever 79 is linked to a crank drive 84. The crank drive 84 has a drive shaft 85, a flywheel 86 with a crank pin 87 fastened thereto and a connecting rod 88 which is linked to the lower extension 83 of the transport lever 79. The horizontal conveyer 73 is arranged so that its two transport levers 78 and 79 can swing to the right and left past the chute body 54 if the chute 37 is in the horizontal position, as indicated in FIG. 4.

The crank drive 84 serves not only as a driving device for the horizontal conveyer 73, but also as means for limiting the acceleration and deceleration of the spinning cop to be transported.

Above the cop retainer 41, a thread-presence feeler 89 is arranged. The thread-presence feeler 89 has four similar electro-optical light gates 90. From the thread-presence feeler 89, a functional connection 91 leads to the electromagnetic actuating device 92 of a cop shunting switch 93. The thread-presence feeler 89 can be activated with delay if the held-back spinning cop 40 is released (FIG. 2). The delay is provided specifically by the provision that the thread-presence feeler 89 is at the same time designed as a cop-presence feeler and for this purpose has a switching delay device 94 which switches from cop measurement to thread measurement, after the cop-presence signal has ceased and a set delay time has expired. If no thread can be ascertained at the time of the thread measurement, the cop shunting switch 93 is set automatically to "shunt" (indicated in phantom in FIG. 4). The absence of a thread makes one expect that the spinning cop in question, for instance, the spinning cop 95 in FIG. 4, cannot be prepared correctly. This spinning cop is then shunted off via a slider 96 and can be collected in a collecting tank 97 (FIG. 1) or automatically returned to the cop preparation station 5.

Between the suction device 43 and the thread-presence feeler 89, is a controlled residual thread cutter 98. The residual thread cutter 98 serves the purpose of shortening the dragged-along thread end to a given dimension, after the thread-presence feeler 89 has ascertained the presence of the dragged-along thread end. The residual thread cutter 98 can therefore be controlled by the thread-presence feeler 89. To this end, the electromagnetic actuating device 99 of the residual thread cutter 98 has a functional connection 100 to the thread-presence feeler 89.

The spinning cops are prepared for their function as unwinding coils in the following manner:

According to FIG. 1, not yet tip-oriented spinning cops 101 are lifted up by the elevator 6, travel individually and sequentially into the cop turner 7 and from there, onto the cop conveyer belt 8. In the cop conveyer belt 8, the spinning cops 13 stand aligned already tip-oriented with the tips of the cop tubes pointing upward. According to FIG. 5, the feeder 15 transports the spinning cops 13 individually and sequentially to the cop delivery point 10. On the way from the cop turner 7 to the individual feeder 11 of the cop delivery point 10, the thread ends are found on the cop surface by means of the blower device 9 and the pulling-off device 17, are transported down, gripped and pulled off. In the process, the cops can be rotated about their own axes by driven, endless round cords 102, 103 (FIG. 2).

The elevator 6, the cop turner 7, the cop conveyer belt 8, the individual feeder 11 and the feeder 15 operate in a matched rhythm. The individual feeder 11 has a plunger 104 which pushes a spinning cop brought up by the feeder 15 down to the cop retainer 41 unless it already drops on the cop retainer 41 by itself. Before this point, the thread ends of the spinning cops have already been given special treatment. At the end of the pulling-off rolls 19 and 20 is located a thread cutter 105 which operates continuously and shortens the thread ends. The shortened thread ends are gripped and held by the suction device 22 (FIG. 5). It is ensured thereby that a spinning cop falling down on the cop retainer 41 drags along its thread end. The dragged-along thread end is subsequently sucked into the suction device 43, as is shown in FIG. 2.

The tiltable chute 37 likewise operates in a rhythm which is matched to the rhythm of the individual feeder 11. FIG. 2 shows the chute 37 at the time when it is swung up into the vertical position, shortly before the cop retainer 41 is swung out. At this time, the chute 37 is still empty.

FIG. 3 shows the chute 37 in the vertical position. The cop retainer 41 was swung to one side by the chute, so that the spinning cop 40 could drop into the funnel 45. The base of the cop tube 106 is now above the mouth of the curved suction tube 63 of the suction device 38.

The light gates 90 were switched to measuring the presence of cops as long as the spinning cop 40 was still resting on the cop retainer 41. However, as soon as the tip of the cop tube 106 has passed the light gates 90, the cop-presence signal stops and the time delay device 94 goes into operation. At the expiration of a fixed delay time, the light gates 90 are switched to thread measurement. Now, the much weaker thread signal must be determined accurately. If the presence of a thread end 42 is ascertained, the functional connection 91 remains inactive and the cop shunting switch 93 is not swung into the transport path of the transporting means 23. If, however, the thread signal fails to arrive, the cop shunting switch is activated because in this case there is no expectation that the spinning cop can be prepared properly.

The functional connection 100 is likewise activated by the thread-presence feeler 89, whereby a dragged-along thread end 42 is cut off by the operation of the residual thread cutter 98. The thread end 42 drops down in the direction toward the spinning cop 40 and in the process is seized by the suction air which flows through the spinning cop or its cop tube and is drawn into the tube.

On its way to the funnel 45, the spinning cop 40 slid along the device 59 for preventing thread layers from being knocked off. The device 59 then rests against the upper end surface of the spinning cop 40, as is shown in FIG. 3. The thread end 42' which is already sucked into the cop tube can now no longer be pulled off the spinning cop 40 for any length of time under the influence of the suction air. Further pulling-off is prevented or inhibited by the device 59.

After a brief stay in the vertical position, the chute 37 now is swung into the horizontal position. To this end, the crank drive 68 goes into action. The crank drive 68 is moved nearly from the lower dead-center position. The tilting velocity now has a sinusoidal waveform. The tilting motion starts slowly and also ends slowly. During the tilting motion, the thread cutter 64 is actuated. At the same time, the suction air also no longer acts on the thread end which has now been shortened for the second time. Since the spinning cop 40 is brought into the horizontal position quite gently, the thread end cannot be flung forward out of the cop tube 106.

As soon as the spinning cop 40 has reached the horizontal position, the horizontal conveyer 73 goes into operation. Its starting position is shown in FIG. 2. The motion of its transport levers 78 and 79 begins from approximately the dead-center position of the crank drive 84. Therefore, the travel of the spinning cop 40 also has a sinusoidal waveshape up to the position 40'' (FIG. 2). The two transport levers 78 and 79 swing, according to FIG. 4, to the left and right of the chute body 54 through the chute 37, and grip the spinning cop 40 in the process, which yields and opens the flaps 55 and 56 which make contact resiliently. The spinning cop then rolls via the sliding surface 74 all the way to the transporting means 23. This transport also has a sinusoidal waveform; it begins and ends gently. The sucked-up thread end is not flung out of the cop tube. The transporting means 23, finally, move only at moderate speed, so that there also, an adverse effect on the sucked-up thread end need not be expected.

According to FIG. 2, while the transport levers 78 and 79 move into the position 79', the chute 37 is swung back into the vertical position, as is likewise shown in FIG. 2. The start of the backward movement is chosen so that the horizontal conveyer 73 cannot be affected adversely. Also the two crank drives 68 and 84 work in the rhythm of the overall device and are matched to each other.

There are two possibilities for operating the cop preparation station 5:

Either, spinning cops are continuously put on the transporting means 23, or the cop preparation station operates only by request on the part of the automatic bobbin winding machine 1. In the first case, excess spinning cops again and again fall into the collecting box 25; in the second case, the delivery of the properly prepared spinning cops corresponds exactly to the demands of the bobbin winding machine.

The invention is not limited to the embodiment example shown and described. For instance, above the flap 59, a thread rejection flap 107 which can yield laterally when the cop drops and can then be swung back above the cop tube 106 into the chute 37 can be arranged. The thread rejection flap 107 fulfills the purpose of conducting a thread which may be held by the flap 59 to the upper opening of the cop tube 106, so that the thread end can be sucked up better there. In order to prevent the thread end from giving way laterally, the thread rejection flap 107 may have an extension 108, 109 on both sides, each of which dip into a slot 110, 111 respectively, which are made, in a side wall of the chute 37.

We claim:

1. Device for depositing and keeping a thread end in a cop tube of a spinning cop from a cop delivery point of a cop preparation station to cop transporting means, comprising a pivotable chute with upper and lower ends disposed between the cop delivery point and the cop transporting means for receiving a spinning cop with a dragged-along thread end, a switchable suction device disposed at said lower end of said chute for supplying the cop tube with suction, and a device for tilting said chute from a vertical position to a horizontal position, said tilting device including means for limiting acceleration and deceleration of the spinning cop in said chute during tilting.

2. Device according to claim 1, wherein said suction device includes a controlled thread cutter.

3. Device according to claim 1, including a cop retainer disposed at the delivery point being controlled by said chute.

4. Device according to claim 3, wherein said cop retainer is a swing being moved with said chute when said chute is pivoted into the vertical position, being pivotable laterally, and being released when said chute is pivoted into the horizontal position, and said delivery point being closeable.

5. Device according to claim 3, including a cop shunting switch disposed downstream of said chute in cop travel direction, a thread-presence feeler being disposed above said cop retainer and being activated with a delay when a retained cop is released, and a functional connection connected between said thread-presence feeler and said cop shunting switch.

6. Device according to claim 5, wherein said thread-presence feeler is also a cop-presence feeler issuing a cop-presence signal, and said thread and cop-presence feeler includes a switching delay device switching from cop measurement to thread measurement after said cop-presence signal stops and after a given time delay has expired.

7. Device according to claim 1, including a horizontal conveyer disposed between said chute and the transporting means, said horizontal conveyer including means for limiting acceleration and deceleration of a spinning cop disposed on said horizontal conveyer.

8. Device according to claim 1, wherein said means for limiting acceleration and deceleration of a spinning cop disposed in said chute are in the form of a crank drive.

9. Device according to claim 7, wherein said means for limiting acceleration and deceleration of a spinning cop disposed on said horizontal conveyer are in the form of a crank drive.

10. Device according to claim 1, including means disposed in said chute for preventing threads from being knocked off the spinning cop in said chute.

11. Device according to claim 10, including a flap disposed above said preventing means, said flap yielding laterally in said chute when the spinning cop drops in said chute and subsequently swinging back in said chute above the cop tube of the spinning cop.

* * * * *